US005548387A

United States Patent [19]

Fukami et al.

[11] Patent Number: 5,548,387

[45] Date of Patent: Aug. 20, 1996

[54] REVERSAL DEVELOPING SYSTEM PREVENTING OCCURRENCE OF IMAGE SPOTS

[75] Inventors: Toshiyuki Fukami; Masashi Tanaka, both of Osaka, Japan

[73] Assignee: Mita Industrial Co., Ltd., Osaka, Japan

[21] Appl. No.: 202,363

[22] Filed: Feb. 25, 1994

[30] Foreign Application Priority Data

Feb. 26, 1993 [JP] Japan ..... 5-38998

[51] Int. Cl.[6] ..... G03G 15/16

[52] U.S. Cl. ..... 355/274; 355/219; 355/268

[58] Field of Search ..... 355/210, 211, 355/219, 268, 274, 277, 271

[56] References Cited

U.S. PATENT DOCUMENTS

| | | | |
|---|---|---|---|
| 4,959,688 | 9/1990 | Koitabashi | 355/219 |
| 5,006,902 | 4/1991 | Araya | 355/271 |
| 5,034,777 | 7/1991 | Ohzeki et al. | 355/274 |
| 5,103,265 | 4/1992 | Kohyama | 355/269 |
| 5,151,736 | 9/1992 | Ohzeki et al. | 355/208 |
| 5,182,604 | 1/1993 | Asai | 355/273 |
| 5,213,927 | 5/1993 | Kan et al. | 430/59 |
| 5,235,386 | 8/1993 | Tano et al. | 355/219 |
| 5,321,471 | 6/1994 | Ito et al. | 355/219 |
| 5,386,279 | 1/1995 | Fukami et al. | 355/271 |

FOREIGN PATENT DOCUMENTS 01200277 8/1989 Japan .

*Primary Examiner*—Robert Beatty
*Attorney, Agent, or Firm*—Sherman and Shalloway

[57] ABSTRACT

A reversal developing system using a photosensitive material that can be electrically charged into both a positive polarity and a negative polarity, and a DC voltage applied to the transfer roller has a polarity opposite to and more than 1.5 times as great than that of the charge start potential by the primary charger, and is so set that the potential on the surface of the photosensitive material after discharge is 50 V or smaller in absolute value. Therefore, the discharging is effectively carried out after the image has been formed, the photosensitive material is uniformly and effectively charged by the main charger even in the subsequent cycle of forming image, a good image is formed without image spots, and the toner image formed on the photosensitive material is transferred maintaining a high transfer efficiency. The transfer roller is arranged to have a gap between the transfer roller and photosensitive surface between 0.3 to 0.7 mm.

11 Claims, 4 Drawing Sheets

REVERSAL DEVELOPING SYSTEM PREVENTING OCCURRENCE OF IMAGE SPOTS

BACKGROUND OF THE INVENTION (1.) Field of the Invention The present invention relates to an image-forming apparatus employing a so-called reversal developing system, and more specifically to an image-forming apparatus of a reversal developing system preventing the occurrence of image spots.

(2.) Description of the Prior Art

An image-forming apparatus employing the reversal developing system has heretofore been known. In this reversal developing system, the photosensitive material is uniformly charged to a positive or negative polarity, the image is exposed to a laser beam or a like beam, and electrostatic latent image is formed on a portion irradiated with light that corresponds to the document image maintaining a residual potential of 0 V to 100 V attenuated by the light. Then, the toner charged to the same polarity as the charging polarity of the photosensitive material is brought into contact with the photosensitive material to effect developing, and the toner adhered to the surface of the photosensitive material on a portion having the potential of 0 V to 100 V is transferred onto a transfer material such as a paper to form the image.

According to the above-mentioned method of forming image based on the reversal developing system, the toner image formed on the surface of the photosensitive material is transferred by applying a DC voltage of a polarity opposite to the polarity of the charge of the toner image to the transfer roller. During the step of transfer, therefore, the surface of the photosensitive material is likely to be charged into an opposite polarity. Besides, the discharge is not effectively carried out and the subsequent image cannot be effectively formed.

In order to solve the above-mentioned defect of the image-forming apparatus employing the reversal developing system, Japanese Laid-Open Patent Publication No. 7086/1989 proposes means in which a DC voltage applied to the transfer roller is set to be lower than a charge start voltage at which the photosensitive material starts electrically charged.

According to the above-mentioned means of the prior art, however, the transfer roller is impressed with a DC voltage which is lower than the charge start voltage. Therefore, the transfer becomes poor due to a drop in the transfer efficiency and leaves problems that must be solved for obtaining good image.

In the image-forming apparatus of the reversal developing system, when a voltage higher than the charge start voltage is applied to the transfer roller, on the other hand, there develops a charge of a polarity opposite to that of the initial charge of the photosensitive material. The potential of the charge of this opposite polarity cannot be removed through the step of discharge effected prior to beginning the step of electrophotography. During the step of main charging, therefore, there develop portions having low charge potentials due to offset in the potential, resulting in the occurrence of spots in the charge potential, i.e., image spots. The image spots appear to be offensive even on images described with lines and become conspicuous particularly on half-tone images.

SUMMARY OF THE INVENTION

The object of the present invention therefore is to provide an image-forming apparatus employing a reversal developing system which effectively carries out the discharging after the image is formed, and effectively and uniformly charges the photosensitive material by a main charger even in a subsequent cycle of forming the image, making it possible to form a favorable image without image spots.

Another object of the present invention is to provide an image-forming apparatus of a reversal developing system which makes it possible to transfer a toner image formed on the surface of the photosensitive material maintaining a high transfer efficiency.

According to the present invention, there is provided an image-forming apparatus of a reversal developing system having a photosensitive material, a main charger, a device for exposing image, a reversal developing device, a transfer device and a discharger, wherein said transfer device has a transfer roller arranged near the surface of the photosensitive material, and a DC voltage is applied to the transfer roller when a transfer material is passing between the transfer roller and the photosensitive material so that a toner image formed on the surface of the photosensitive material is transferred onto the transfer material, and wherein said photosensitive material is the one that can be electrically charged into both the positive polarity and the negative polarity, and the DC voltage applied to the transfer roller has a polarity opposite to that of the charged potential by the changer, is greater than a charge start voltage of the photosensitive material, and is so set that the potential on the surface of the photosensitive material after discharged is 50 V or smaller in an absolute value.

DETAILED DESCRIPTION OF THE INVENTION

A conspicuous feature of the present invention resides in an image-forming apparatus having a photosensitive material, a main charger, a device for exposing image, a reversal developing device, a transfer device and a discharger, wherein said transfer device has a transfer roller arranged near the surface of the photosensitive material, and a DC voltage is applied to the transfer roller when a transfer material is passing between the transfer roller and the photosensitive material so that a toner image formed on the surface of the photosensitive material is transferred onto the transfer material, and wherein said photosensitive material is the one that can be electrically charged into both the positive polarity and the negative polarity, and the DC voltage applied to the transfer roller has a polarity opposite to that of the charged potential by the charger, is greater than a charge start voltage of the photosensitive material, and is so set that the potential on the surface of the photosensitive material after discharged is 50 V or smaller in an absolute value. The photosensitive material can have a charge start voltage of 300 V to 2000 V.

In the field of electrophotography, the photosensitive material that can be electrically charged to both the positive polarity and the negative polarity stands for the one that can be not only simply charged into both the positive polarity and the negative polarity but also permits the charged potential to be effectively attenuated by the light even when it is positively charged or negatively charged.

Figure 2A:
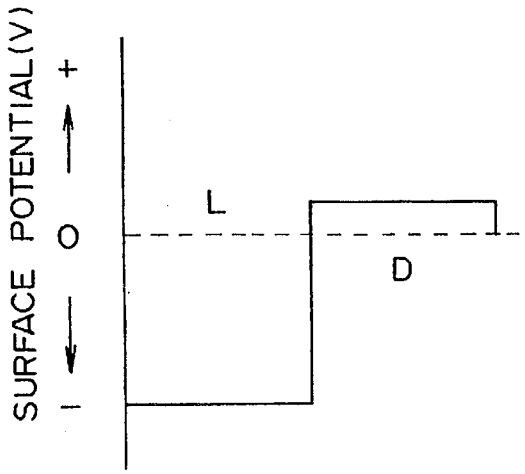
FIGS. 2A and 2B are diagrams illustrating a relationship between the residual potential and the position of the surface of the photosensitive material after the discharge of the photosensitive material has been finished.
Figure 2B:
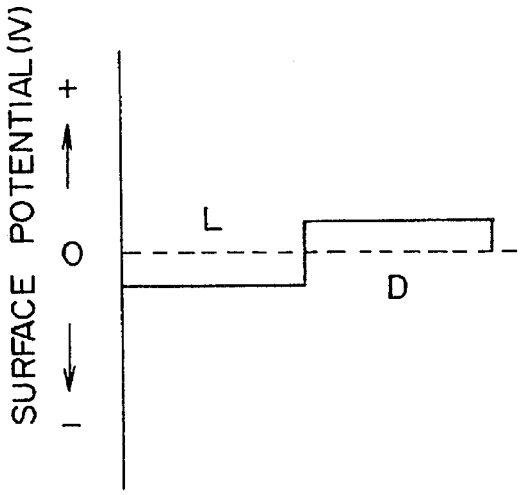
Figure 3A:
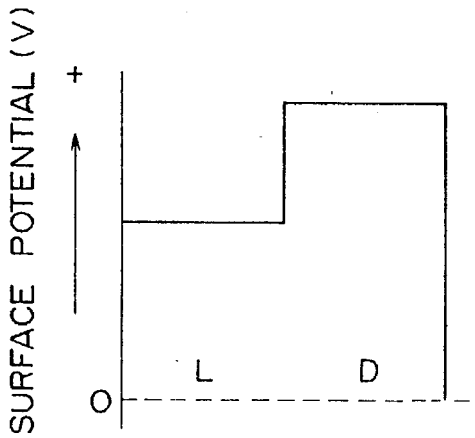
FIGS. 3A and 3B are diagrams illustrating a relationship between the surface potential and the position of the surface of the photosensitive material after the main charging of the photosensitive material has been finished.
Figure 3B:
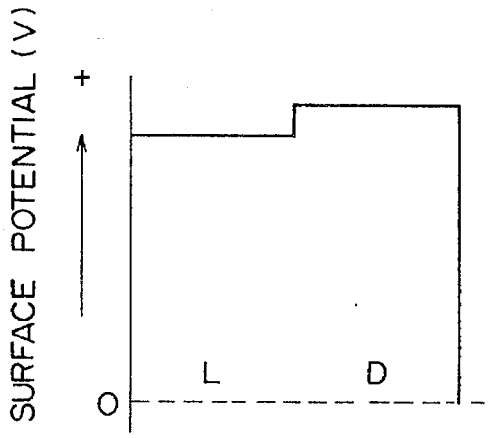

FIGS. 2A and 2B illustrate a relationship between the residual potential and the position of the surface of the photosensitive material after the transfer of the photosensitive material has been finished, FIG. 2 illustrates a relationship between the residual potential and the position of the surface of the photosensitive material after the photosensitive material has been discharged, and FIGS. 3A and 3B show a relationship between the surface potential and the position of the surface of the photosensitive material after the main charging of the photosensitive material has been finished. In these drawings, symbol A represents a photosensitive material that can be charged into one polarity only and symbol B represents a photosensitive material that can be charged into both the positive polarity and the negative polarity. To simplify the description, described below with reference to these drawings are the cases where the photosensitive materials are charged into the positive polarity.

Figure 1A:
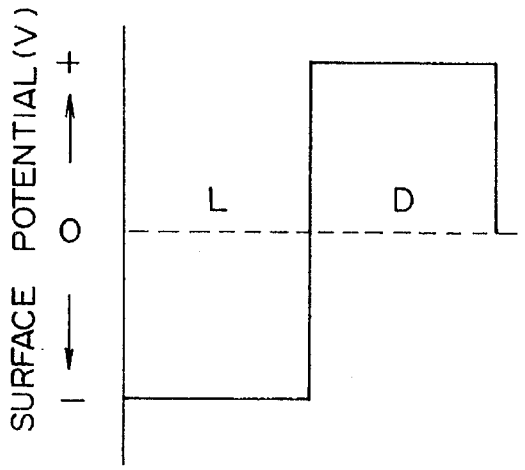
FIGS. 1A and 1B are diagrams illustrating a relationship between the residual potential and the position of the surface of the photosensitive material after the transfer of the photosensitive material has been finished.
Figure 1B:
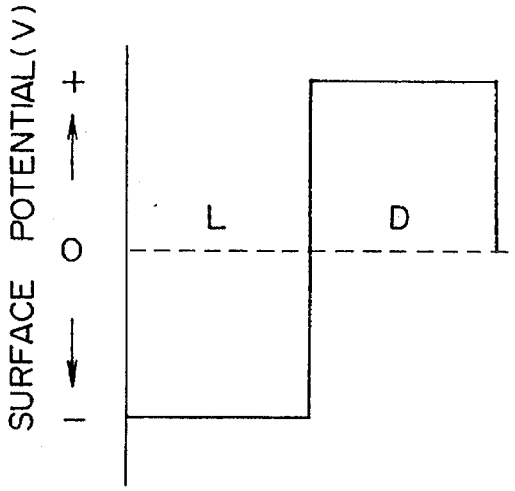

When the DC voltage applied to the transfer roller has a polarity (−) opposite to the polarity (+) of the charge by the charger and has a value larger than a charge start voltage of the photosensitive material, the residual potential FIGS. 1A and 1B after the transfer of the photosensitive material has been finished becomes (+) at the dark portion D and (−) at the bright portion L, either in the photosensitive material A and the photosensitive material B.

When the photosensitive materials are discharged FIGS. 2A and 2B, however, the positive potential at the dark portion D greatly decreases but the negative potential at the bright portion L does not almost decrease in the case of the photosensitive material A which can be charged into one polarity (+) only. In the case of the photosensitive material B that can be charged into both the positive polarity and the negative polarity, on the other hand, both the positive potential at the dark portion D and the negative potential at the bright portion L greatly decrease. This seriously affects the subsequent step of main charging.

When the photosensitive materials after discharged are put to the main charging FIGS. 3A and 3B, the charge potential at the dark portion D remains normal but the charge potential at the bright portion L decreases being offset by the negative potential in the case of the photosensitive material A that can be charged into one polarity(+) only. In the case of the photosensitive material B that can be charged into both the positive and negative polarities, on the other hand, the negative potential at the bright portion L greatly drops and, hence, both the dark portion D and the bright portion L are uniformly charged to a high potential.

Figure 4:
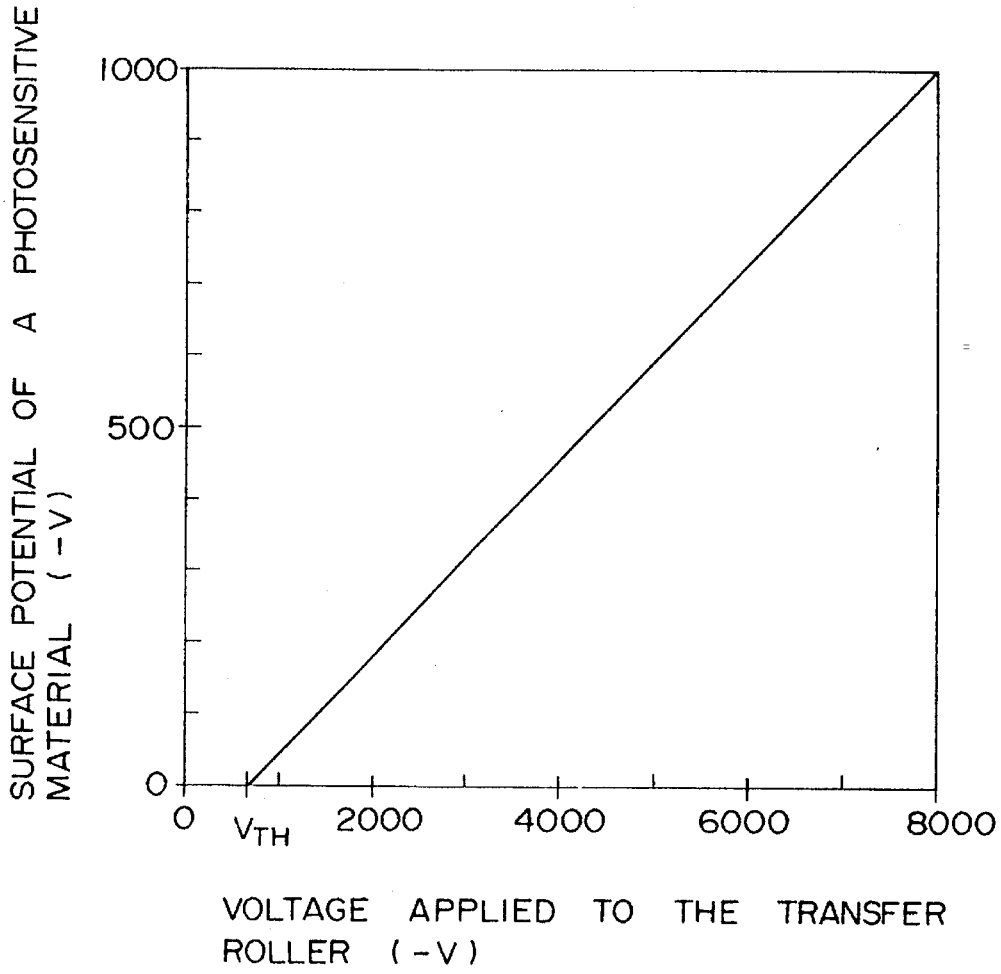
FIG. 4 is a diagram illustrating a relationship between the voltage applied to a transfer roller and the potential on the surface of the photosensitive material.

Referring to FIG. 4 illustrating a relationship between the voltage applied to the transfer roller and the surface potential of the photosensitive material, the surface potential of the photosensitive material is almost zero if it is not greater than the charge start voltage ($V_{TH}$). However, the toner transfer efficiency is low since the voltage applied to the transfer roller is at a low level. According to the present invention, on the other hand, the voltage applied to the transfer roller is set to be greater than the charge start voltage ($V_{TH}$) so that even when the surface potential of the photosensitive material increases due to the electric charging, the surface potential of the photosensitive material by the transfer roller is lowered as described with reference to FIGS. 1A and 1B to 3A and 3B. Accordingly, the uniformity of the charging is not adversely affected in the step of main charging, and the toner transfer efficiency is improved.

Figure 5:
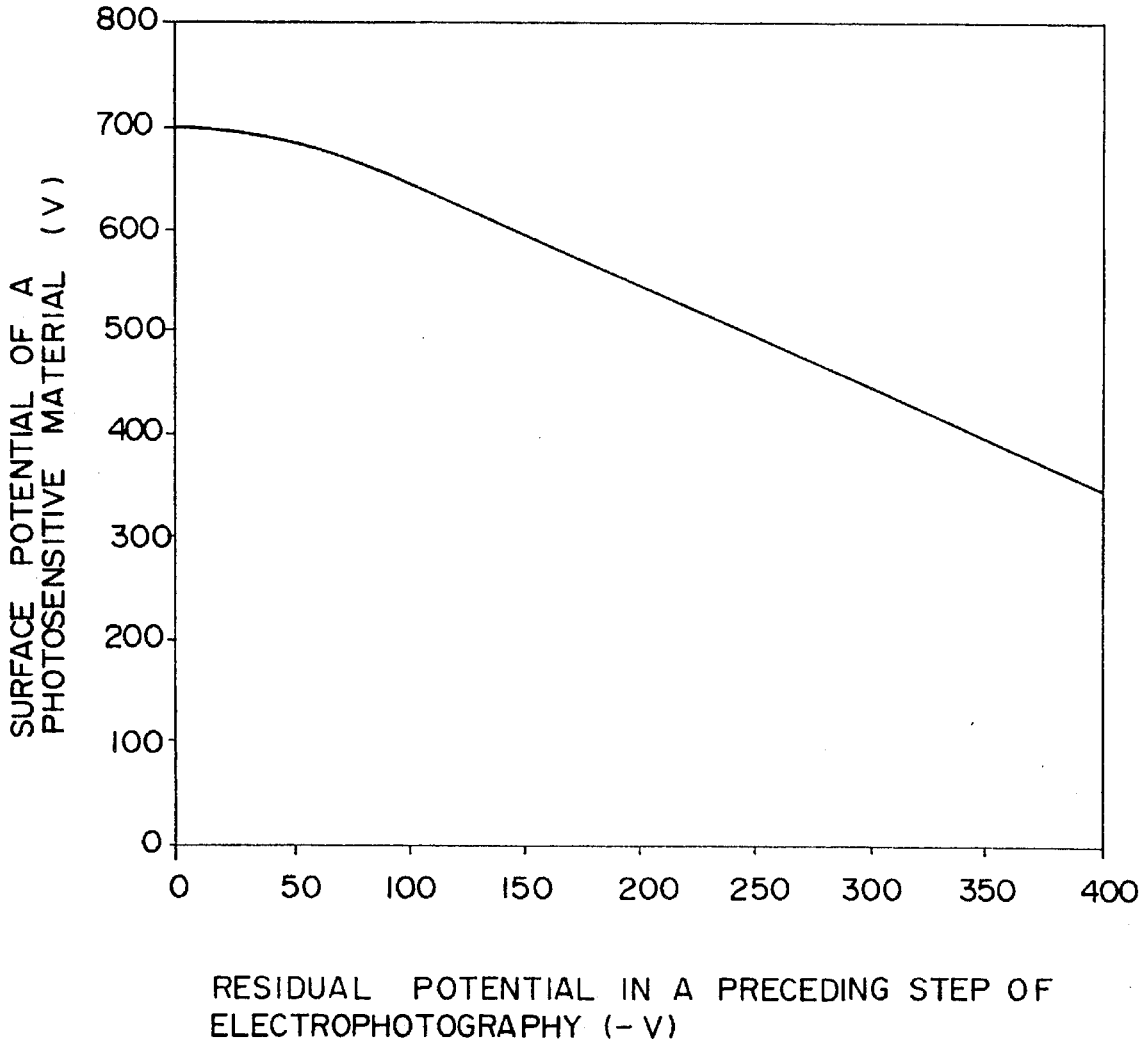
FIG. 5 is a diagram illustrating a relationship between the residual potential due to the preceding step of electrophotography and the surface potential when the main charging is effected with a polarity opposite to that of the residual potential.

Referring to FIG. 5 illustrating a relationship between the residual potential due to the preceding step of electrophotography and the surface potential of when the main charging is effected with a polarity opposite to that of the residual potential, the surface potential by the main charging drops as a matter of course being offset by the residual potential. However, when the absolute value of the residual potential is smaller than 50 V and is, particularly, smaller than 30 V, the uniformity of the image is not almost affected. When the absolute value of the residual potential exceeds 50 V, however, the drop of the surface potential becomes no longer negligible, and the uniformity of the image is adversely affected.

According to the image-forming apparatus employing the reversal developing system of the present invention, the discharging is effectively carried out even after the image has been formed, and the photosensitive material is uniformly and effectively charged by the main charger even in the subsequent cycle of forming image. Therefore, a good image is formed without image spots, and the toner image formed on the photosensitive material is transferred maintaining a high transfer efficiency.

Photosensitive Material

The photosensitive material that can be charged into both the positive polarity and the negative polarity used in the present invention may be any one that has been known per se. According to the present invention, however, it is desired to use an organic photosensitive material having an organic photosensitive layer of a single dispersion type provided on an electrically conducting substrate, the organic photosensitive layer containing a charge-generating agent, an electron-transporting agent and a positive hole-transporting agent that are dispersed in the resin medium.

The photosensitive layer contains a charge-generating agent, an electron-transporting agent and a positive hole-transporting agent in a single layer, and can, hence, be electrically charged into both the positive polarity and the negative polarity, enabling the residual potential to be suppressed to a low level and exhibiting excellent sensitivity.

Examples of the charge-generating agent include selenium, selenium-tellurium, amorphous silicon, a pyrylium salt, an azo type pigment, a dis-azo type pigment, an anthanthrone type pigment, a phthalocyanine type pigment, an indigo type pigment, a threne type pigment, a toluidine type pigment, a pyrazoline type pigment, a perylene type pigment and a quinacridone type pigment, which will be used in one kind or being mixed in two or more kinds so as to exhibit a wave-absorption band over a desired region.

Particularly preferred examples include an X-type metal-free phthalocyanine, an oxotitanyl phthalocyanine, a perylene type pigment, and, particularly, the one represented by the following general formula (1),

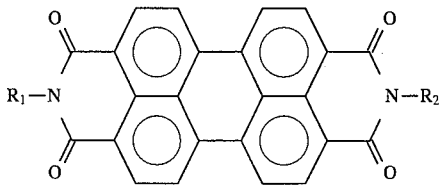

(1)

wherein $R_1$ and $R_2$ are substituted or unsubstituted alkyl groups with less than 18 carbon atoms, cycloalkyl groups, aryl groups, alkaryl groups or aralkyl groups.

Examples of the alkyl group may be an ethyl group, a propyl group, a butyl group, and a 2-ethylhexyl group, examples of the cycloalkyl group may be a cyclohexyl group and the like, examples of the aryl group may be a phenyl group and a naphthyl group, examples of the alkaryl group may be a tolyl group, a xylyl group and an ethylphenyl group, and examples of the aralkyl group may be a benzyl group and a phenetyl group. Examples of the substituent are alkoxy group, a halogen atom and the like.

A variety of resins can be used as resin media for dispersing the charge-generating agent, such as olefin type polymers, e.g., a styrene type polymer, an acrylic polymer, a styrene-acrylic polymer, an ethylene-vinyl acetate copolymer, a polypropylene and an ionomer, as well as photo-curing type resins, e.g., a polyvinyl chloride, a vinyl chloride-vinyl acetate copolymer, a polyester, an alkyd resin, a polyamide, a polyurethane, an epoxy resin, a polycarbonate, a polyallylate, a polysulfone, a diallyl phthalate resin, a silicone resin, a ketone resin, a polyvinyl butyral resin, a polyether resin, a phenol resin and an epoxyacrylate. These binder resins can be used in a single kind or being mixed in two or more kinds. Preferred examples of the resin include the styrene type polymer, acrylic polymer, styrene-acrylic polymer, polyester, alkyd resin, polycarbonate and polyallylate.

Particularly preferred resin is a polycarbonate derived from bisphenols represented by the following. general formula (2)

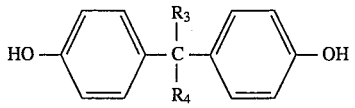

(2)

wherein $R_3$ and $R_4$ are hydrogen atoms or lower alkyl groups, and $R_3$ and $R_4$ being bonded together may form a cyclic ring such as a cyclohexane ring together with a bonded carbon atom, and a phosgene.

Any known electron-transporting agent having electron-transporting property can be used. Preferred examples include electron attractive substances such as a paradiphenoquinone derivative, a benzoquinone derivative, a naphthoquinone derivative, a tetracyanoethylene, a tetracyanoquinodimethane, a chloroanil, a bromoanil, a 2,4,7-trinitro-9-fluorenone, a 2,4,5,7-tetranitro-9-fluorenone, a 2,4,7-trinitro-9-dicyanomethylenefluorenone, a 2,4,5,7-tetranitroxanthone, a 2,4,8-trinitrothioxanthone, or those electron attractive substances having high molecular weights.

Among them, the paradiphenoquinone derivative and, particularly, an asymmetrical paradiphenoquinone derivative is preferred because of its excellent solubility and excellent electron-transporting property.

The invention uses the paradiphenoquinone derivative represented by the following general formula (3)

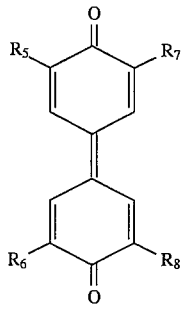

(3)

wherein $R_5$, $R_6$, $R_7$ and $R_8$ are hydrogen atoms, alkyl groups, cycloalkyl groups, aryl groups, aralkyl groups or alkoxy groups.

It is desired that $R_5$, $R_6$, $R_7$ and $R_8$ are substituents of asymmetrical structure, and two out of $R_5$, $R_6$, $R_7$ and $R_8$ are lower alkyl groups, and another two are branched-chain alkyl groups, cycloalkyl groups, aryl groups or aralkyl groups.

Though not limited thereto only, suitable examples include a 3,5-dimethyl-3',5'-di-t-butyldiphenoquinone, a 3,5-dimethoxy-3',5'-di-t-butyidiphenoquinone, a 3,3'-dimethyl-5,5'-di-t-butyldiphenoquinone, a 3,5'-dimethyl-3',5-di-t-butyldiphenoquinone, a 3,5,3',5'-tetramethyldiphenoquinone, a 2,6,2',6'-tetra-t-butyldiphenoquinone, a 3,5,3',5'-traphenyldiphenoquinone, a 3,5,3',5'-tetracyclohexyldiphenoquinone and the like. These diphenoquinone derivatives are desirable because they have a small mutual action among molecules owing to their low molecular symmetry, and exhibit excellent solubility.

The following compounds have been known as the positive hole-transporting substances. Among them, the compounds having excellent solubility and positive hole-transporting property are used. That is, hydrazone salts such as a pyrene, an N-ethylcarbazole, an N-isopropyicarbazole, an N-methyl-N-phenylhydrazine-3-methylidyne-9-carbazole, an N,N-diphenylhydrazino-3-methylidyne-9-ethylcarbazole, an N,N-diphenylhydrazino-3-methylidyne-10-ethylphenothiazine, an N,N -diphenylhydrazino-3-methylidyne-10-ethylphenoxazine, a p-diethylaminobenzaldehyde-N,N-diphenylhydrazone, a p-diethylaminobenzaldehyde-α-naphthyl-N-phenylhydrazone, a p-pyrrolidinobenzaldehyde-N,N-diphenylhydrazone, a 1,3,3-trimethylindolenine-ω-aldehyde-N,N-diphenylhydrazone, and a p-diethylbenzaidehyde-3-methylbenzthiazolinone-2-hydrazone; pyrazolines such as a 2,5-bis(p-diethylaminophenyl)-1,3,4-oxadiazole, a 1-phenyl-3-(p-diethylaminostyryl)-5-(p-diethylaminophenyl) pyrazoline, a 1-[quinonyl(2)]-3-(p-diethylaminostyryl)-5-(p-diethylaminophenyl) pyrazoline, a 1-[pyridyl(2)]-3-(p-diethyiaminostyryl)-5-(p-diethylaminophenyl) pyrazoline, a 1-[6-methoxy-pyridyl(2)]-3-(p-diethyiaminostyryl)-5-(p-diethylaminophenyl) pyrazoline, a 1-[pyridyl(3)]-3-(p-diethyiaminostyryl)-5-(p-diethylaminophenyl) pyrazoline, a 1-[lepidyl(3)]-3-(p-diethyiaminostyryl)-5-(p-diethylaminophenyl) pyrazoline, a 1-[pyridyl(2)]-3-(p-diethyiaminostyryl)-4-methyl-5-(p-diethylaminophenyl) pyrazoline, a 1-[pyridyl(2)]-3-(α-methyl-p-diethyiaminostyryl)-3-(p-diethylaminophenyl) pyrazoline, a 1-phenyl-3-(p-diethyiaminostyryl)-4-methyl-5-(p-diethylaminophenyl) pyrazoline, and spiropyrazoline; oxazole type compounds such as a 2-(p-diethyiaminostyryl)-3-diethylaminobenzoxazole, and a 2-(p-diethylaminophenyl)-4-(p-dimethylaminophenyl)-5-(2-chlorophenyl) oxazole; thiazole type compounds such as a 2-(p-diethyiaminostyryl)-6-diethylaminobenzoxazole and the like; triarylmethane type compounds such as a bis(4-diethylamino-2-methylphenyl) phenylmethane and the like; polyarylalkanes such as a 1,1-bis(4-N,N-diethylamino-2-methylphenyl) heptane, a 1,1,2,2-tetrakis(4-N,N-dimethylamino-2-methylphenyl) ethane and the like; benzidine type compounds such as an N,N'-diphenyl-N,N'-bis(methylphenyl) benzidine, an N,N'-diphenyl-N,N'-bis(ethylphenyl) benzidine, an N,N'-diphenyl-N,N'-bis(propylphenyl) benzidine, an N,N'-diphenyl-N,N'-bis(butylphenyl) benzidine, an N,N'-bis(isopropylphenyl) benzidine, an N,N'-diphenyl-N,N'-bis(secondary butylphenyl) benzidine, an N,N'-diphenyl-N,N'-bis(tertiary butylphenyl) benzidine, an N,N'-diphenyl-N,N'-bis(2,4-dimethylphenyl) benzidine, and an N,N'-diphenyl-N,N'-bis(chlorophenyl) benzidine; and a triphenylamine, a poly-N-vinylcarbazole, a polyvinylpyrene, a polyvinylanthracene a polyvinylacridine, a poly-9-vinylphenylanthracene, a pyrene-formaldehyde resin and an ethylcarbazoleformaldehyde resin.

Among them, it is desired to use a benzidine type transporting agent and, particularly, a transporting agent represented by the general formula (4)

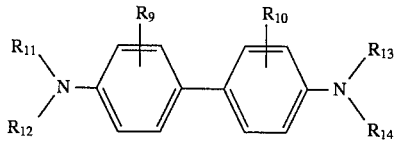

wherein $R_9$ and $R_{10}$ are lower alkyl groups such as methyl groups or ethyl groups, and $R_{11}$, $R_{12}$, $R_{13}$ and $R_{14}$ are alkyl groups with less than 18 carbon atoms, cycloalkyl groups, aryl groups, alkaryl groups or aralkyl groups, and a carbazolehydrazone type transporting agent and, particularly, a transporting agent represented by the general formula (5)

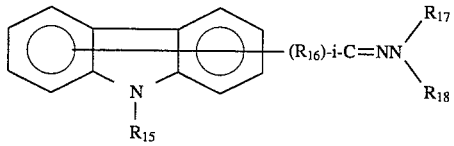

(5)

wherein $R_{15}$ is a hydrogen atom, an alkyl group or an acyl group, $R_{l6}$ is a divalent organic group such as an alkylene group, and $R_{17}$ and $R_{18}$ are alkyl groups with less than 18 carbon atoms, cycloalkyl groups, aryl groups, alkaryl groups or aralkyl groups, because of their good solubility and positive hole-transporting property.

In the single dispersion type photosensitive material used in the present invention, the charge-generating agent (CGM) should be contained in the photosensitive layer in an amount of 0.1 to 5% by weight and, particularly, 0.25 to 2.5% by weight with respect to the solid components, the electron-transporting agent should be contained in the photosensitive layer in an amount of 5 to 50% by weight and, particularly, 10 to 40% by weight with respect to the solid component, and the positive hole-transporting agent should be contained in the photosensitive layer in an amount of 5 to 50% by weight and particularly, 10 to 40% by weight with respect to the solid component. In this case, it is most desired that the electron-transporting agent and the positive hole-transporting agent are contained at a weight ratio of from 1:9 to 9:1 and, particularly, from 1:8 to 8:2.

The composition for forming the photosensitive material of the present invention may be blended with a variety of known blending agents such as an antioxidizing agent, a radical-trapping agent, a singlet quencher, an ultraviolet ray absorbing agent, a softening agent, a surface reforming agent, a defoaming agent, a filler, a viscosity-increasing agent, a dispersion stabilizer, a wax, an acceptor and a donor within ranges that do not adversely affect the electrophotographic properties.

When a steric hindrance phenol type antioxidizing agent is blended in an amount of 0.1 to 50% by weight relative to the whole solid components, furthermore, the durability of the photosensitive layer can be strikingly improved without adversely affecting the electrophotographic properties.

As the electrically conducting substrate on which the photosensitive layer is to be provided, there can be used a variety of materials having electric conductivity such as metals, e.g., aluminum, copper, tin, platinum, gold, silver, vanadium, molybdenum, chromium, cadmium, titanium, nickel, indium, stainless steel, brass and the like, plastic materials on which the above metals are deposited or laminated, and glasses coated with an aluminum iodide, a tin oxide, an indium oxide or the like oxide.

The photosensitive material of the single layer dispersion type of the present invention does not generate interference fringe, and, hence, uses an ordinary aluminum blank tube and, particularly, a blank tube so treated with alumite as to have a film thickness of from 1 to 50 μm.

The photosensitive material of the type of the single dispersion layer is formed by mixing the charge-generating material, charge-transporting agent and a binder resin by a widely known method such as a roll mill, a ball mill, a paint shaker or an ultrasonic wave dispersing machine and, then, applying the mixture by the known application means, followed by drying.

Though there is no particular limitation, the photosensitive layer should have a thickness of, generally, from 5 to 100 μm and, particularly, from 10 to 50 μm.

A variety of organic solvents can be used as a solvent for forming the coating solution, such as alcohols, e.g., methanol, ethanol, isopropanol and butanol; aliphatic hydrocarbons, e.g., n-hexane, octane and cyclohexane; aromatic hydrocarbons, e.g., benzene, toluene and xylene; halogenated hydrocarbons, e.g., dichloromethane, dichloroethane, carbon tetrachloride and chlorobenzene; ethers, e.g., dimethyl ether, diethyl ether, tetrahydrofurane, ethylene glycol dimethyl ether, and diethylene glycol dimethyl ether; ketones, e.g., acetone, methyl ethyl ketone, and cyclohexanone; esters, e.g., ethyl acetate and methyl acetate; dimethylformamide and dimethyl sulfoxide, which may be used in one kind or being mixed in two or more kinds. The coating solution should have a solid component concentration of, usually, from 5 to 50%.

Image-Forming Apparatus

Figure 6:
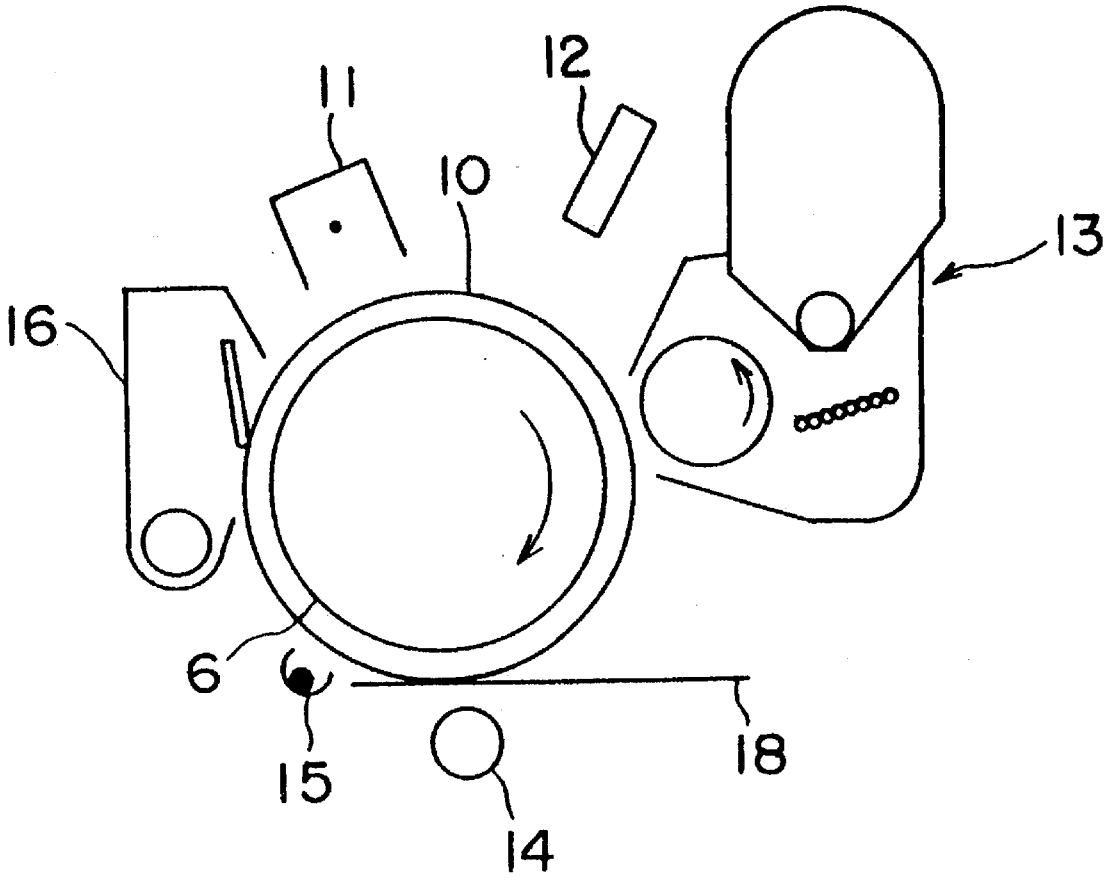
FIG. 6 is a diagram of arrangement schematically illustrating the image-forming apparatus of the present invention.

Referring to FIG. 6 schematically illustrating the image-forming apparatus according to the present invention, around a rotary photosensitive material drum 6 equipped with the above-mentioned organic photosensitive layer 10 are arranged a corona charger 12 for main charging, an optical system 12 for image exposure equipped with a light source of laser beam, a developer 13, a transfer roller 14, a light source 15 for discharging, and a device 16 for cleaning residual toner.

In forming the image, the photosensitive layer 10 of the photosensitive material drum 6 is uniformly charged into a positive or a negative polarity by the corona charger 11. The photosensitive material can have a charge start voltage of 300 V to 2000 V. Due to this main charging, the surface potential of the photosensitive layer 10 is, usually, set to lie from 500 to 700 V in absolute value.

Then, the image is exposed to a laser beam from the optical system 12, the portion of the photosensitive layer 10 corresponding to the image of the document (i.e., the portion irradiated with the laser beam) assumes a potential of from 0 V to 100 V, the portion (background) not irradiated with the laser beam is held at a potential attenuated by dark from the main charged potential, and electrostatic latent image is formed.

The electrostatic latent image is developed by the developer 13 and a toner image is formed on the surface of she photosensitive layer 10. The developing through the developer 13 is carried out based upon a magnetic brush developing method or a like method using a developing agent known per se., e.g., using a one-component type or a two-component type developing agent containing the toner that is charged to the same polarity as the main charging polarity of the photosensitive layer 10. That is, on the portion irradiated with the laser beam is formed the toner image that is charged to the same polarity as the main charging polarity. In this case, a suitable bias voltage is applied across the developer 13 and the photosensitive material drum 6 to efficiently carry out the developing like in the prior art.

The toner image formed on the surface of the photosensitive layer is transferred onto the transfer material 18 such as a paper that has passed through between the transfer roller 14 and the photosensitive material drum 6. The photosensitive layer 10 is then discharged by the irradiation with light from the light source 15 for discharging.

The transfer roller 14 is made of a composition obtained by blending an elastomer polymer with an electrically conducting powder. It is desired that the electrically conducting rubber has a volume resistivity of usually from $10_7$ Ω·cm to $10^{14}$ Ω·cm and a surface hardness of 50° (JIS A) or higher.

As the elastomer polymer, there can be used, for example, a nitril-butadiene rubber (NBR), a styrene-butadiene rubber (SBR), a chloroprene rubber (CR), a polybutadiene (BR), a polyisoprene (IIB), a butyl rubber, a natural rubber, an ethylene-propylene rubber (EPR), an ethylene-propylene-diene rubber (EPDM), a polyurethane, a chlorinated polyethylene, a chlorinated polypropylene, a soft vinyl chloride resin, and the like.

As the electrically conducting powder, there can be used an electrically conducting carbon black, a tin oxide doped with indium or antimony, or a metal powder such as of copper, silver, aluminum and the like. Among them, however, the electrically conducting carbon black is preferred. It is desired that the electrically conducting powder is contained in an amount of from 5 to 70% by weight and, particularly, from 10 to 50% by weight per the whole amount.

In forming the electrically conducting rubber roller, it is allowable to blend widely known blending agents such as a vulcanizing agent of the sulfur type or the organic type, a vulcanization promoting agent, a softening agent, an anti-aging agent, a filler, a dispersing agent, a plasticizer and the like in known amounts.

The transfer roller 14 is arranged maintaining a gap of, usually, smaller than 2 mm and, particularly, from 0.3 to 0.7 mm with respect to the photosensitive material drum 6.

In the step of transfer, the transfer roller 14 is impressed with a DC voltage which has a polarity opposite to the main charging polarity of the photosensitive layer 10 and is higher than the charge start voltage of the photosensitive material. The charge start voltage ($V_{TH}$) of the photosensitive material differs depending upon the kind of the photosensitive material, but lies over a range of from about 0.3 to about 2 KV in the case of the organic photosensitive material of the single dispersion type used in the present invention. It is desired that the applied voltage is more than 1.5 times and, particularly, more than 3 times as great as the charge start voltage ($V_{TH}$) of the photosensitive material from the standpoint of toner transfer efficiency.

On the other hand, the upper limit of the voltage applied to the transfer roller is determined by the surface potential of the photosensitive layer 10 after discharged (residual potential of before the main charging). That is, the applied voltage should be so set that the residual potential of before the main charging is smaller than 50 V and, preferably, smaller than 20 V in absolute value.

That is, as pointed out already, the present invention uses a photosensitive material that can be charged into both the positive polarity and the negative polarity. Therefore, when the surface potential after discharged lies within the above-mentioned range despite the polarity is opposite to that of the main charging, it is allowed to homogeneously effect the main charging in the next cycle of forming the image, and image free of unevenness can be formed even from a half-tone document. This also means that the DC voltage (absolute value) applied to the transfer roller 14 is set to be greater than that of the conventional system, in order to improve the toner transfer efficiency.

After the above-mentioned transfer and discharge are carried out, the toner remaining on the photosensitive layer 10 is removed by the cleaning device 16, and the next cycle is carried out for forming the image. As required, furthermore, the toner image transferred onto the transfer material is fixed onto the transfer material by the application of heat or pressure.

EXAMPLES

The invention will now be described by way of Examples.

Formation of a Photosensitive Drum that Can Be Charged Into Both the Positive Polarity and the Negative Polarity

| | |
|---|---|
| Metal-free phthalocyanine (charge-generating agent): | 5 parts by weight |
| N,N'-Bis(o,p-dimethylphenyl)-N,N'-diphenylbenzidine (positive hole-transporting agent): | 40 parts by weight |
| 3,3',5,5'-Tetraphenyldiphenoquinone (electron-transporting agent): | 40 parts by weight |
| Polycarbonate (binder resin) | 100 parts by weight |
| Dichloromethane (solvent) | 800 parts by weight |

The above components were mixed and dispersed using a paint shaker, and the prepared coating solution was applied onto an aluminum blank tube and was dried with the hot air heated at 60° C. for 60 minutes to obtain an organic photosensitive drum of the type that can be charged into both polarities having a film thickness of 15 μm.

The charge start voltage of this photosensitive material was −680 KV to +695 KV.

Transfer Roller

A polyurethane rubber blended with 20% by weight of carbon black was used as the transfer roller.

EXAMPLES 1, 2 AND COMPARATIVE EXAMPLES 1 to 3

In the image-forming apparatus shown in FIG. 6, a gap between the photosensitive drum and the transfer roller was set to be 0.5 mm, and use was made of a two-component type developing agent using a positively charged toner.

By using this apparatus, the surface of the photosensitive layer was uniformly charged to +700 V by the main charger, the image was exposed to light, and then a bias voltage of +350 V was applied to effect the reversal developing.

Method of Evaluating Half-Tone Unevenness

A half-tone image of an optical reflection density (ID) of about 0.6 was printed, and a difference ΔID between a maximum ID and a minimum ID of the image was measured.

The difference ΔID increases when unevenness occurs in the half-tone.

Method of Evaluating Transfer Property

A line chart was printed on 1000 copies, the weight w1 of the toner consumed and the weight w2 of the toner recovered without being transferred onto the transfer material were measured, and the transfer efficiency was found in compliance with the following formula, $$\text{Transfer efficiency} = \frac{w1 - w2}{w1} \times 100$$

The transfer efficiency decreases when the transfer property is poor.

TABLE 1

| | Charging polarity of photo-sensitive material | Applied voltage | Surface potential of photosensitive material after discharged (Max) | Dark potential of next cycle | ΔID | Transfer efficiency |
|---|---|---|---|---|---|---|
| Example 1 | positive negative | −5.7 KV | −48 V | 655 V | 0.099 | 90.4% |
| Example 2 | positive negative | −3.0 KV | −20 V | 705 V | 0.043 | 87.6% |
| Comparative Example 1 | positive negative | −6.2 KV | −55 V | 617 V | 0.181 | 93.2% |
| Comparative Example 2 | positive negative | −0.5 KV | −10 V | 703 V | 0.056 | 63.3% |
| Comparative Example 3 | positive negative | −3.0 KV | −293 V | 401 V | 0.388 | not measurement |

We claim:

1. An image-forming apparatus comprising a reversal developing system having a photosensitive material, a main charger, a device for exposing an image, a reversal developing device, a transfer device and a discharger, wherein said transfer device has a transfer roller arranged to have a 0.3 to 0.7 mm gap between the transfer roller and the surface of the photosensitive material, wherein said photosensitive material has a charge start voltage, and a DC voltage more than 1.5 times as great as said charge start voltage is applied to the transfer roller when a transfer material is passing between the transfer roller and the photosensitive material so that a toner image formed on the surface of the photosensitive material is transferred onto the transfer material, and wherein said photosensitive material is of the type that can be electrically charged into both the positive polarity and the negative polarity, and the DC voltage applied to the transfer roller has a polarity opposite to that of a charged potential by the charger, is greater than a charge start voltage of the photosensitive material, and is so set that the potential on the surface of the photosensitive material after being discharged is 50 V or smaller in an absolute value, and wherein even when the photosensitive material is charged positively and negatively, light decay of the charge potential provided by the charge start voltage is carried out.

2. An image-forming apparatus according to claim 1, wherein the photosensitive material is an organic photosensitive material having a photosensitive layer of a single dispersion type provided on an electrically conducting substrate, and said photosensitive layer contains a charge-generating agent, an electron-transporting agent and a positive hole-transporting agent that are dispersed in a resin medium.

3. An image-forming apparatus according to claim 1, wherein the photosensitive material has a charge start voltage of from 300 V to 2000 V.

4. An image-forming apparatus according to claim 1, wherein the transfer roller is made of a rubber composition blended with an electrically conducting powder.

5. An image forming apparatus according to claim 1, wherein the potential on the surface of the photosensitive material after applying the charge start voltage is 500 V to 700 V.

6. An image forming apparatus according to claim 1, wherein the potential on the surface of the photosensitive material after discharge is 20 V or smaller in an absolute value.

7. An image-forming apparatus comprising a reversal developing system having a photosensitive material, a main charger, a device for exposing an image, a reversal developing device, a transfer device and a discharger, wherein said transfer device has a transfer roller arranged to have a 0.3 to 0.7 mm gap between the transfer roller and the surface of the photosensitive material, wherein said photosensitive material has a charge start voltage of 300 V to 2000 V, and a DC voltage more than 3.0 times as great as said charge start voltage is applied to the transfer roller when a transfer material is passing between the transfer roller and the photosensitive material so that a toner image formed on the surface of the photosensitive material is transferred onto the transfer material, and wherein said photosensitive material is of the type that can be electrically charged into both the positive polarity and the negative polarity, and the DC voltage applied to the transfer roller has a polarity, opposite to that of a charged potential by the charger, is greater than a charge start voltage of the photosensitive material, and is so set that the potential on the surface of the photosensitive material after being discharged is 50 V or smaller in an absolute value, and wherein even when the photosensitive material is charged positively and negatively, light decay of the charge potential provided by the charge start voltage is carried out.

8. An image forming apparatus according to claim 7, wherein the potential on the surface of the photosensitive material after applying the charge start voltage is 500 V to 700 V.

9. An image forming apparatus according to claim 7, wherein the potential on the surface of the photosensitive material after discharge is 20 V or smaller in an absolute value.

10. An image-forming apparatus according to claim 7, wherein the photosensitive material is an organic photosensitive material having a photosensitive layer of a single dispersion type provided on a electrically conducting substrate, and said photosensitive layer contains a charge-generating agent, an electron-transporting agent and a positive hole-transporting agent that are dispersed in a resin medium.

11. An image-forming apparatus according to claim 7, wherein the transfer roller is made of a rubber composition blended with an electrically conduction powder.

* * * * *